US006813449B2

(12) United States Patent
Miyazaki et al.

(10) Patent No.: US 6,813,449 B2
(45) Date of Patent: Nov. 2, 2004

(54) PROCESS AND APPARATUS FOR FORMING AN IMAGE USING NON-AQUEOUS LIQUID INK

(75) Inventors: Takeshi Miyazaki, Kanagawa (JP); Akio Kashiwazaki, Kanagawa (JP); Hideto Kuribayashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 54 days.

(21) Appl. No.: 10/247,313

(22) Filed: Sep. 20, 2002

(65) Prior Publication Data

US 2003/0063912 A1 Apr. 3, 2003

(30) Foreign Application Priority Data

Sep. 20, 2001 (JP) ..... 2001-287110
Sep. 19, 2002 (JP) ..... 2002-273082

(51) Int. Cl.[7] ..... G03G 15/00
(52) U.S. Cl. ..... 399/2
(58) Field of Search ..... 399/2

(56) References Cited

U.S. PATENT DOCUMENTS 5,371,531 A * 12/1994 Rezanka et al. ..... 347/43
5,570,451 A * 10/1996 Sakaizawa et al. ..... 399/2
5,729,785 A * 3/1998 Sakaizawa et al. ..... 399/2
5,790,915 A * 8/1998 Arcaro et al. ..... 399/2
6,276,792 B1 * 8/2001 Gundlach et al. ..... 347/101
6,424,364 B2 * 7/2002 Gundlach et al. ..... 347/111
6,459,858 B1 * 10/2002 Davis ..... 399/2
6,618,563 B2 * 9/2003 Oakeson et al. ..... 399/2

FOREIGN PATENT DOCUMENTS

| | | |
|---|---|---|
| JP | 7-205542 | 8/1995 |
| JP | 7-223362 | 8/1995 |
| JP | 9-094942 | 4/1997 |

* cited by examiner

*Primary Examiner*—Fred L. Braun
(74) *Attorney, Agent, or Firm*—Fitzpatrick, Cella, Harper & Scinto

(57) ABSTRACT

An image forming process for forming an image on a recording medium includes applying a melting colored powder to the recording medium to fix the powder heating and applying liquid inks containing a colorant in a non-aqueous solvent to the recording medium. An image forming apparatus includes device for forming an image with a melting colored powder and a device for forming an image with liquid inks containing a colorant in a non-aqueous solvent.

6 Claims, 1 Drawing Sheet

FIGURE
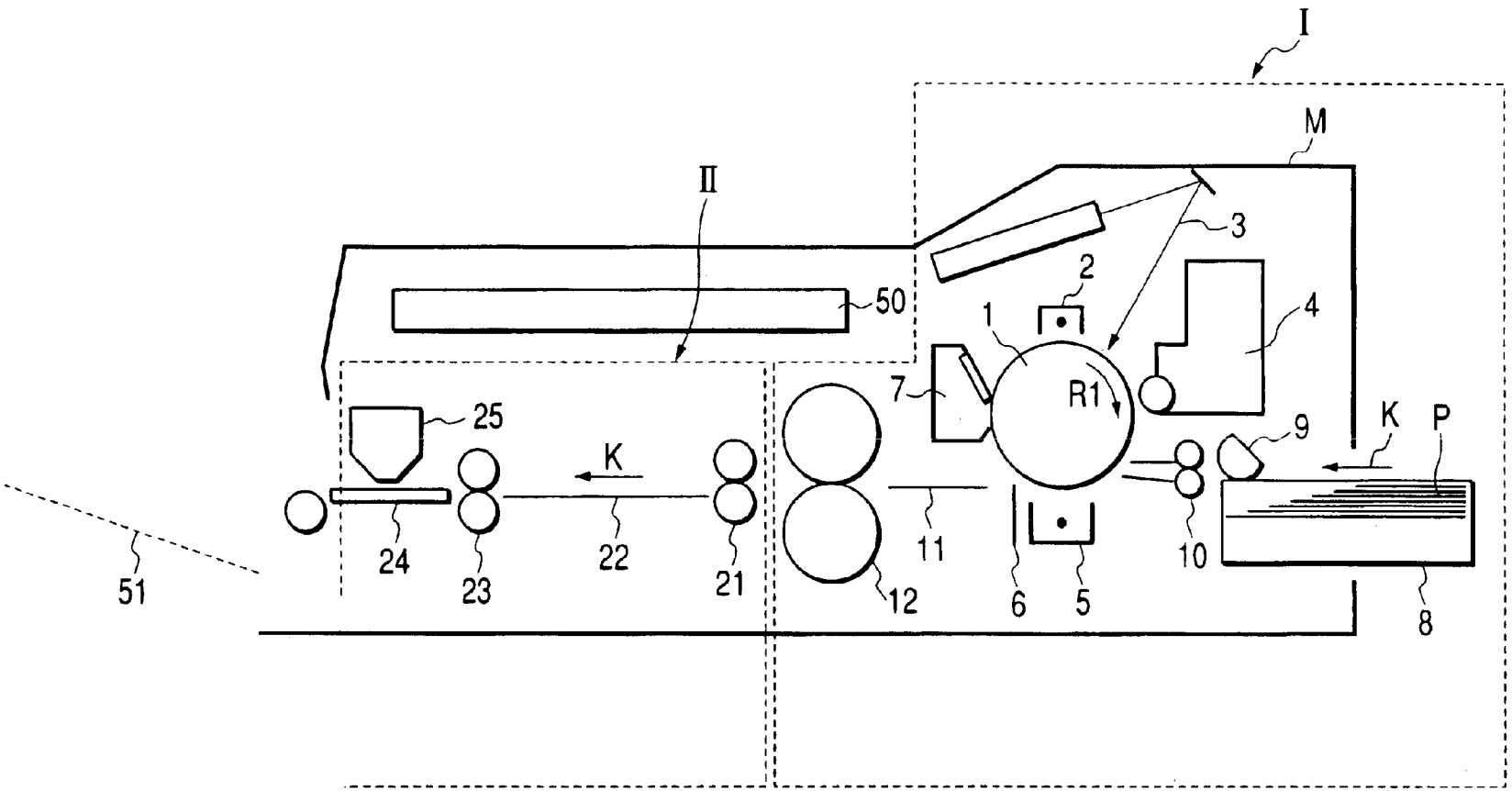

PROCESS AND APPARATUS FOR FORMING AN IMAGE USING NON-AQUEOUS LIQUID INK

BACKGROUND OF THE INVENTION

1. Field of the Invention

The present invention relates to a process and an apparatus for forming a color image with a powder toner and a liquid ink.

2. Related Background Art

As typical methods for forming a color image by a printer, copying machine, facsimile (FAX) or the like, there have heretofore been used an electrophotographic system and an ink-jet system.

In the electrophotographic system, for example, a toner image is formed on a photosensitive drum by charging, exposing and developing means provided around the photosensitive drum, and the toner image is transferred to a recording medium and then fixed by a fixing means. In this case, an apparatus may be constructed in a relatively small size in the case of a monochrome image. However, in the case of a color image, an enlarged apparatus and an increase in cost become a problem.

On the other hand, the latter ink-jet system is such a system that an ink is directly ejected on a recording medium from a recording head to form an ink image. According to this system, a color image can be formed by a relatively small-sized apparatus compared with the electrophotographic system. However, this system is required to be improved in that the printing speed is slow compared with the electrophotographic system, and bleeding between colors occurs when a recording medium is general-purpose plain paper to incur a possibility that the quality of an image formed may be deteriorated.

In order to solve these problems to be improved, for example, Japanese Patent Application Laid-Open Nos. 7-205542, 7-223362, 9-94942 and 11-277814 have proposed image forming processes using both image forming means according to the electrophotographic system and image forming means according to the ink-jet system.

However, the process described in Japanese Patent Application Laid-Open Nos. 7-205542 and 7-223362 is such that recording is conducted by the electrophotographic system using a powder toner, and ink-jet recording is then conducted with a water-based ink, and incurs a possibility that the water-based ink may be repelled by the toner between a toner image-formed portion and an ink image adjacent thereto or at an overlapped portion therebetween according to the composition of the toner previously attached on recording paper or by silicone oil or the like used in a fixing device. In addition, in the case of formation of a color image, an image formed may undergo bleeding due to color mixing between water-based color inks in some cases. Further, a recording medium such as paper swells right after the water-based ink is applied to the recording medium to cause waviness, which may become a cause of wrinkles and/or curling. Japanese Patent Application Laid-Open No. 11-277814 describes an image forming apparatus having a means for changing over a system for forming a black image between the electrophotographic system and the ink-jet system based on the attribute of an object image in order to solve an image failure at an overlapped portion between a toner image and an ink image. However, such an image forming apparatus requires to judge the attribute of the object image, and so a complicated device is necessary. On the other hand, Japanese Patent Application Laid-Open No. 9-94942 states that hot-melt inks such as pigment inks can be used for an ink-jet output mechanism in addition to inks comprising a water-soluble dye. In the case where the hot-melt ink is used, however, heat is applied to the ink-jet output mechanism, so that a toner attached to recording paper may be melted out in some cases to cause an image failure at an overlapped portion between a toner image and an ink-applied area. Further, when the hot-melt ink is applied so as to overlap with a toner image, the hot-melt ink may be swollen at the overlapped portion.

SUMMARY OF THE INVENTION

The present invention has been made with the foregoing problems in view and has as its object the provision of image forming process and apparatus, by which a good-quality image can be formed while avoiding enlarging the apparatus and increasing the cost thereof, and neither wrinkle nor curling occurs.

The present inventors have investigated various liquid inks and processes with a view toward achieving the above object. As a result, it has been found that when non-aqueous liquid inks are used, the inks are hard to be repelled by a toner between a toner image-formed portion and an ink image adjacent thereto or at an overlapped portion therebetween, and wrinkles and curling are hard to occur because bleeding due to color mixing between the inks becomes hard to occur on an image formed, and a recording medium is not swollen, thus leading to completion of the present invention.

According to the present invention, there is provided an image forming process for forming an image on a recording medium, which comprises the steps of applying a melting powder toner to the recording medium to fix the toner by heating and applying liquid inks to the recording medium, wherein the liquid inks contain a colorant in a non-aqueous solvent.

In the image forming process, the melting powder toner may preferably contain a black colorant.

At least three liquid inks of a yellow, magenta and cyan colors may be preferably used as the liquid inks.

At least four liquid inks of a yellow, magenta, cyan and black colors may also be preferably used as the liquid inks.

In the step of applying the liquid inks, the inks may preferably be applied to the recording medium by an ink-jet recording method.

According to the present invention, there is also provided an image forming apparatus comprising a means for forming an image with a melting powder toner and a means for forming an image with liquid inks, wherein the liquid inks contain a colorant in a non-aqueous solvent.

BRIEF DESCRIPTION OF THE DRAWING

FIGURE typically illustrates the whole construction of an example of the image forming apparatus according to the present invention.

DETAILED DESCRIPTION OF THE PREFERRED EMBODIMENT

The melting powder toner used in the present invention is melting colored powder often used in copying machines of the electrophotographic system and laser beam printers and is generally prepared by mixing and dispersing a colorant, charge accelerating additive, magnetite, etc. in a thermoplastic binder resin and powdering the resultant dispersion.

The liquid inks used in the present invention are inks that are liquid at ordinary temperature, which contain at least a colorant in a non-aqueous solvent.

As the colorants of the liquid inks, may be used various kinds of dyes, pigments, inorganic particles, metal particles, colored polymers, colored waxes, etc. Among others, oil-soluble dyes and pigments are preferably used. The content of the colorant contained in each liquid ink is preferably 0.3 to 20% by mass, more preferably 1 to 10% by mass based on the total mass of the ink. If the content is lower than 0.3% by mass, sufficient optical density may not be achieved in some cases. If the content exceeds 20% by mass on the other hand, it may be difficult in some cases to smoothly eject the resulting ink on a recording medium such as plain paper.

Examples of the oil-soluble dyes include azo dyes and phthalocyanine dyes, and examples of the oil-soluble pigments include inorganic pigments such as carbon black, and organic pigments such as azo pigments, phthalocyanine pigments, isoindoline pigments, quinacridone pigments and perinone-perylene pigments. Besides, processed pigments with surfaces of particles coated with a resin or the like may also be used. These dyes and pigments may also be used in combination of two or more thereof according to circumstances.

Examples of the resin used for coating the pigments or the resin used for stabilizing the dispersion of the pigments include ethyl cellulose, poly(acrylic esters), linseed oil-half modified alkyl resins, polystyrene, polyvinyl chloride, chlorinated polypropylene, polyamide resins, coumarone-indene resins, rosin resins, terpene phenol resins and alkylphenol-modified xylene resins. These resins may also be used in combination of two or more thereof according to circumstances.

As the non-aqueous solvent, is used any of other colorless liquids than water, for example, ketones, alcohols and carboxylic acid esters. In particular, such a liquid preferably has low toxicity and emits little odor. For example, aliphatic hydrocarbons such as isoparaffinic hydrocarbons and normal paraffinic hydrocarbons, alicyclic hydrocarbons, vegetable oils, and various kinds of silicone oils are used. These non-aqueous solvents may also be used in combination of two or more thereof.

The amount of the non-aqueous solvent in the ink is preferably 50 to 98% by weight, more preferably 70 to 95% by weight, still more preferably 80 to 95% by weight.

A surfactant is preferably suitably added to the liquid inks. The amount of the surfactant added is preferably 0.05 to 5% by weight, more preferably 0.1 to 2% by weight based on the ink. Any surfactant may be used so far as they are compatible with the non-aqueous solvent or stably dispersible therein as fine particles. Specific suitable examples thereof include nonionic surfactants such as sorbitan fatty acid esters (sorbitan monooleate, sorbitan monolaurate, sorbitan sesquioleate, sorbitan trioleate, etc.), polyoxyethylene sorbitan fatty acid esters (polyoxyethylene sorbitan monostearate, polyoxyethylene sorbitan monooleate, etc.), polyethylene glycol fatty acid esters (polyoxyethylene monostearate, polyethylene glycol diisostearate, etc.) and polyoxyethylene alkyl phenyl ethers (polyoxyethylene nonyl phenyl ether). These surfactants may also be used in combination of two or more thereof according to circumstances.

A resin as a binder component may also be added to the liquid inks. Examples of usable resins include phenol resins, acrylic resins and modified resins thereof, maleic acid resins and modified resins thereof, rosin resins, epoxy resins, silicone resins, fluororesins and butyral resins.

An oxidant, an ultraviolet absorbent and the like may also be suitably added as additives to the liquid inks.

Water may be present, in a range of not more than 5% by mass in the inks. However, the content of water is as low as possible because separation may occur on the inks in some cases.

The embodiments of the present invention will hereinafter be described in detail with reference to the drawing. FIGURE typically illustrates the whole construction of an example of the image forming apparatus according to the present invention.

In the present invention, a powder toner is applied to a recording medium by a method represented by an electrophotographic method, and a toner image formed by the toner is then fixed to the recording medium by heating. Liquid inks comprising a non-aqueous solvent are then applied to the recording medium by an ink-jet method to form a multi-color image.

The image forming apparatus shown in FIGURE has a plurality of image forming means different in image forming system from each other and forms an image on a recording medium P by a series of image forming steps by these image forming means. Incidentally, the image forming apparatus of this embodiment may conduct both recordings of ink-jet recording and electrophotographic recording, namely, "montage" or "multiple" recording. In the present invention, recording that an ink image area by the ink-jet recording and a toner image area by the electrophotographic recording do not overlap with each other is referred to as "montage" and recording that both areas overlap with each other is called "multiple".

The outline of the whole construction of the image forming apparatus will be first described. This image forming apparatus is equipped with an image forming means I of the electrophotographic system as a first image forming apparatus (a portion surrounded by a dotted line on the right side in FIGURE) arranged on the upstream side of an apparatus body M and an image forming means II of the ink-jet system as a second image forming apparatus (a portion surrounded by a dotted line on the left side in FIGURE) arranged on the downstream side thereof.

The "upstream side" and "downstream side" of the apparatus body M refer to the conveying direction (direction of an arrow K) of the recording medium P in a series of the image forming steps, and the right side and the left side in the drawing are the upstream side and the downstream side, respectively.

With respect to the overall operation of the image forming apparatus of the above-described construction, a monochromatic toner image is formed with a melting powder toner (hereinafter referred to as "toner") as a developer by the image forming means (electrophotographic system) I on the upstream side, and a color ink image is formed with plural inks of different colors by the image forming means (ink-jet system) II on the downstream side.

The respective constructions will now be described in order of the image forming means I and the image forming means II.

The image forming means I is equipped with, as an image-carrying member, a photosensitive drum 1 rotated and driven in a direction of an arrow R1. A charging means 2, an exposing means 3, a developing means 4, a transferring means 5, a static charge eliminating means 6 and a cleaning means 7 are provided around the photosensitive drum 1 along the rotating direction (the direction of the arrow R1) thereof in order almost named. These means are composed of a primary charger 2 which uniformly charges the surface of the photosensitive drum 1 to a predetermined negative potential, a laser exposer 3 which conducts image exposure on the surface of the photosensitive drum 1 charged to form an electrostatic latent image, a developing device 4 which applies a toner to the electrostatic latent image to conduct reversal development, a transferring charger 5 which transfers the toner image on the photosensitive drum 1 to a recording medium P, an static charge eliminating rod 6 which eliminates a charge on the recording medium P after the transferring, and a cleaner 7 which removes the toner remaining on the photosensitive drum 1 after the transferring, respectively. In the developing device 4 in this embodiment, the toner is applied to the electrostatic latent image on the photosensitive drum 1 by, for example, jumping development.

As the toner used herein, may be used an insulating magnetic toner prepared so as to contain 60% by mass of magnetite and 1% by mass of a metal complex of an azo dye as a negative charge control agent in a binder resin comprising, for example, a styrene-acrylic copolymer as a main component and have a volume resistivity of about $10^{13}$ Ω·cm.

A feeding and conveying section of the recording medium P is constructed below the photosensitive drum 1. In the feeding and conveying section, are arranged, in order from the upstream side, a paper cassette 8 which contains recording media P and is detachably installed in the apparatus body M, a feed roller 9 for feeding the recording medium P from the paper cassette 8, resist rollers 10 for feeding the recording medium P fed to the photosensitive drum 1 at the prescribed timing, and a conveyer guide 11 for guiding the recording medium P after transferring of the toner image. A heat fixing device 12 as a heat fixing means for fixing the toner image transferred from on the photosensitive drum 1 by the transferring charger 5 on the recording medium P is arranged on the most downstream side of the feeding and conveying section.

The image forming means II is equipped with a carrying roller 21, a conveyer guide 22, feed rollers 23, a platen 24 and an ink-jet recording section 25 in order from the upstream side. The carrying rollers 21 continuously deliver the recording medium P discharged from the heat fixing device 12 toward the feed rollers 23 (in the direction of the arrow K) along the conveyer guide 22, the feed rollers 23 intermittently convey the recording medium P between the platen 24 and the ink-jet recording section 25 by means of a stepping motor (not illustrated). The ink-jet recording section 25 is constructed by three line heads of the piezoelectric system for three color inks of cyan C, magenta M and Yellow Y. Incidentally, the line heads capable of forming an image at high speed are used herein from the viewpoint of the balance with the speed of the electrophotographic system. However, other ink-jet recording heads than the line heads may also be used.

Further, a black liquid ink may also be used in addition to the three liquid inks of a yellow, magenta and cyan colors. In other words, the ink-jet recording section may also be constructed by four line heads with a head for the black ink added to the above-described construction. This construction is effective for conducting recording by only the ink-jet system on an OHP sheet or the like.

When granularity of a color image is reduced to particularly desire smooth gradation, inks of special colors such as pale magenta and pale cyan may also be added in addition to the three liquid inks of a yellow, magenta and cyan colors.

Tubes (not illustrated) corresponding to the heads for the respective color inks are connected to the recording heads, and the respective inks are fed from ink tanks (not illustrated) for the inks through these tubes. A controller 50 is arranged above the second image forming means II. The controller 50 is constructed in such a manner that when print signals and mixed image data containing date of a monochromatic image and data of a color image are inputted from, for example, an external system, the print signals and the data of the monochromatic image are sent to the first image forming means I, while the print signals and the data of the color image are sent to the second image forming means II.

A discharge tray 51 on which the recording medium after completion of the formation of the image is discharged is arranged on the more downstream side than the image forming means II.

The description of the construction of the image forming means I and the image forming means II in the image forming apparatus has been completed above, and the operation of these means will be now described.

When print signals and mixed image data containing date of a monochromatic image and data of a color image are inputted into the image forming apparatus from the external system, the controller 50 sends the print signals and the data of the monochromatic image to the first image forming means I. As a result, one of the recording media P in the paper cassette 8 is fed by the feed roller 9 and sent to the photosensitive drum 1 through the resist rollers 10. The photosensitive drum 1 is rotated and driven in a direction of an arrow R1 in almost parallel with the operation described above, and the surface of the photosensitive drum 1 is uniformly charged to a predetermined negative potential by the primary charger 2. The photosensitive drum 1 is exposed to a laser beam by the laser exposer 3 based on the image data to eliminate the charge of the exposed portion, thereby forming an electrostatic latent image on the surface of the photosensitive drum 1. The black toner of a negative charge contained in the developing device 4 is applied to the latent image to develop the latent image as a toner image. The toner image on the photosensitive drum 1 is transferred by the transferring charger 5 to a recording medium P fed from the resist rollers 10 to the photosensitive drum 1. The recording medium P after the transferring of the toner image is conveyed to the heat fixing device 12 along the conveyer guide 11 and heated and pressed here to melt and fix the toner image. On the other hand, the photosensitive drum 1 after the transferring of the toner image is provided for the next image formation after the toner remaining on the surface thereof is removed by the cleaner 7.

The recording medium P is conveyed from the first image forming means I to the second image forming means II when a monochromatic toner image is formed through the respective image forming steps in the first image forming means I. The carrying rollers 21 in the second image forming means II continuously convey the recording medium P until the leading edge of the recording medium P reaches the feed rollers 23 when the recording medium P is entered. When the leading edge of the recording medium P reaches the feed rollers 23, the feed rollers 23 and the carrying rollers 21 intermittently convey the recording medium P to the ink-jet recording section 25. At this time, the print signals and the data of the color image are sent to the second image forming means II, and the respective inks are ejected from the ink-jet heads of the ink-jet recording section 25 corresponding to these signals and data to form a color image.

EXAMPLE 1

Three liquid color inks of the following respective compositions were prepared. Incidentally, all designations of "%" as will be used in the following compositions mean % by weight.

| [Composition of yellow Y ink] | |
|---|---|
| Y pigment (C.I. Pigment Yellow 93) | 5.0% |
| Isoparaffinic hydrocarbon solvent (Isopar G, trade name, product of Exxon Chemical Co.) | 92.6% |
| Sorbitan monolaurate | 0.2% |
| Rosin-modified maleic resin (Malkyd 33, trade name, product of Arakawa Chemical Industries, Ltd.). | 2.2% |
| [Composition of magenta M ink] | |
| M pigment (C.I. Pigment Red 122) | 4.0% |
| Isoparaffinic hydrocarbon solvent (Isopar G, trade name, product of Exxon Chemical Co.) | 93.6% |
| Sorbitan monolaurate | 0.2% |
| Rosin-modified maleic resin (Malkyd 33, trade name, product of Arakawa Chemical Industries, Ltd.). | 2.2% |
| [Composition of cyan C ink] | |
| C pigment (C.I. Pigment Blue 15:3) | 5.0% |
| Isoparaffinic hydrocarbon solvent (Isopar G, trade name, product of Exxon Chemical Co.) | 92.6% |
| Sorbitan monolaurate | 0.2% |
| Rosin-modified maleic resin (Malkyd 33, trade name, product of Arakawa Chemical Industries, Ltd.). | 2.2% |

A melting powder toner (toner of EP-82 Toner Cartridge (Black), trade name, product of Canon Inc.) and the three liquid inks were used to form a multi-color image on paper (PB PAPER, trade name, product of Canon Inc.) by the apparatus of the above-described construction and the process described above.

Comparative Example 1

A multi-color image was formed in the same manner as in EXAMPLE 1 except that three water-based liquid color inks of the following respective compositions were used.

| [Composition of yellow Y ink] | |
|---|---|
| Y pigment (C.I. Pigment Yellow 93) | 5.0% |
| Salt of styrene-acrylic copolymer (acid value: 200, weight average molecular weight: about 10,000) | 1.0% |
| Diethylene glycol | 8.0% |
| Glycerol | 5.0% |
| Trimethylolpropane | 5.0% |
| Distilled water | 76.0%. |
| [Composition of magenta M ink] | |
| M pigment (C.I. Pigment Red 112) | 4.0% |
| Salt of styrene-acrylic copolymer (acid value: 200, weight average molecular weight: about 10,000) | 1.0% |
| Diethylene glycol | 8.0% |
| Glycerol | 5.0% |
| Trimethylolpropane | 5.0% |
| Distilled water | 77.0%. |

-continued

| [Composition of cyan C ink] | |
|---|---|
| C pigment (C.I. Pigment Blue 15:3) | 5.0% |
| Salt of styrene-acrylic copolymer (acid value: 200, weight average molecular weight: about 10,000) | 1.0% |
| Diethylene glycol | 8.0% |
| Glycerol | 5.0% |
| Trimethylolpropane | 5.0% |
| Distilled water | 76.0%. |

<Evaluation Result>

The image samples of EXAMPLE 1 and COMPARATIVE EXAMPLE 1 were compared with each other, and as a result a high-quality image free of repelling of the inks was obtained in EXAMPLE 1, while an uneven image undergoing ink repelling was obtained in COMPARATIVE EXAMPLE 1. With respect to bleeding between color inks, the image obtained in EXAMPLE 1 underwent less bleeding.

As described above, according to the present invention, an image is formed by a step of applying a melting powder toner to a recording medium and a step of applying liquid inks containing a colorant in a non-aqueous solvent to the recording medium, whereby the inks are hard to be repelled by the toner between a toner image-formed portion and an ink image adjacent thereto or at an overlapped portion therebetween. As a result, uniform, high-quality images can be provided. In addition, bleeding due to color mixing between the inks can be made hard to occur, and so the image becomes more sharper. Further, wrinkles and curling are hard to occur because a recording medium such as paper is not swollen, so that printing can be performed at higher speed.

As described above, an image forming process capable of forming an excellent color image even by a relatively small-sized and cheap apparatus, and an apparatus for it can be provided according to the present invention.

What is claimed is:

1. An image forming process for forming an image on a recording medium, which comprises the steps of applying a melting colored powder to the recording medium to fix the powder by heating and applying liquid inks to the recording medium, wherein the liquid inks contain a colorant in a non-aqueous solvent.

2. The image forming process according to claim 1, wherein the melting colored powder contains a black colorant.

3. The image forming process according to claim 1, wherein at least three liquid inks of yellow, magenta and cyan colors are used as the liquid inks.

4. The image forming process according to claim 1, wherein at least four liquid inks of yellow, magenta, cyan and black colors are used as the liquid inks.

5. The image forming process according to claim 1, wherein in the step of applying the liquid inks, the inks are applied to the recording medium by an ink-jet recording method.

6. An image forming apparatus comprising a means for forming an image with a melting colored powder and a means for forming an image with liquid inks, wherein the liquid inks contain a colorant in a non-aqueous solvent.

* * * * *